US011167196B2

(12) United States Patent
Bellah

(10) Patent No.: US 11,167,196 B2
(45) Date of Patent: Nov. 9, 2021

(54) AUTOMATED FOOTBALL THROWING APPARATUS AND ATTACHMENT

(71) Applicant: Thomas Julian Bellah, Sanderson, TX (US)

(72) Inventor: Thomas Julian Bellah, Sanderson, TX (US)

( * ) Notice: Subject to any disclaimer, the term of this patent is extended or adjusted under 35 U.S.C. 154(b) by 0 days.

(21) Appl. No.: 15/995,427

(22) Filed: Jun. 1, 2018

(65) Prior Publication Data

US 2019/0366185 A1 Dec. 5, 2019

(51) Int. Cl.
*A63B 69/40* (2006.01)
*A63B 71/06* (2006.01)

(52) U.S. Cl.
CPC ..... *A63B 69/40* (2013.01); *A63B 69/406* (2013.01); *A63B 71/0622* (2013.01); *A63B 71/0686* (2013.01); *A63B 2071/0625* (2013.01); *A63B 2225/50* (2013.01); *A63B 2243/007* (2013.01)

(58) Field of Classification Search
CPC ..... A63B 69/40; A63B 69/406; F41B 4/00
See application file for complete search history.

(56) References Cited

U.S. PATENT DOCUMENTS 4,723,532 A * 2/1988 Osojnak ..... A63B 69/406 124/48
5,417,196 A * 5/1995 Morrison ..... A63B 69/40 124/6
5,776,018 A * 7/1998 Simpson ..... A63B 24/0021 473/433
6,241,628 B1 * 6/2001 Jenkins ..... A63B 69/0071 124/6
7,553,244 B2 * 6/2009 York ..... A63B 47/002 124/78
8,932,156 B2 * 1/2015 Boehner ..... A63B 69/406 124/78
9,555,306 B2 * 1/2017 Lewis ..... A63B 69/40

* cited by examiner

*Primary Examiner* — John A Ricci
(74) *Attorney, Agent, or Firm* — Karl L. Larson

(57) ABSTRACT

An automated football throwing machine that includes a housing, a flexible portion, a transport portion, an activation module and a power module. The housing includes a receiving portion for receiving a football and an ejecting portion for adjustably ejecting the football. The flexible portion includes an integrated chute configured to gravity funnel a football into the receiving portion. The transport portion is configured to transport the football from the receiving portion to the ejecting portion. The activation module is configured to engage the ejecting portion to eject the football. The power module is configured to electrically power the transport portion and the activation module.

24 Claims, 3 Drawing Sheets

AUTOMATED FOOTBALL THROWING APPARATUS AND ATTACHMENT

BACKGROUND OF THE INVENTION

Field of the Invention

The present invention is generally related to apparatus for throwing a football, and more particularly to an automated football throwing apparatus and attachment.

Discussion of the Background

Football throwing machines known in the prior art require manual loading of the football in an operational mode. Such a configuration either requires a dedicated person to operate the football throwing machine or the receiver of the thrown football to repeatedly return to the football throwing machine, for loading purposes of the football.

Thus, there currently exist deficiencies in football throwing machine designs.

SUMMARY OF THE INVENTION

Accordingly, one aspect of the present invention is to provide an automated football throwing machine that includes a housing, a flexible portion, a transport portion, an activation module and a power module. The housing includes a receiving portion for receiving a football and an ejecting portion for adjustably ejecting the football. The flexible portion includes an integrated chute configured to gravity funnel a football into the receiving portion. The transport portion is configured to transport the football from the receiving portion to the ejecting portion. The activation module is configured to engage the ejecting portion to eject the football. The power module is configured to electrically power the transport portion and the activation module.

Another aspect of the present invention is to provide an automated football throwing attachment attached to an automated football apparatus. The automated football apparatus includes a housing having a receiving portion for receiving a football and an ejecting portion for adjustably ejecting the football. The automated football throwing attachment includes a flexible portion, an activation module and a power module. The flexible portion has an integrated chute configured to gravity funnel a football into the receiving portion. The activation module is configured to engage the ejecting portion to eject the football. The power module is configured to electrically power the activation module.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION THE PREFERRED EMBODIMENTS

Figure 1:
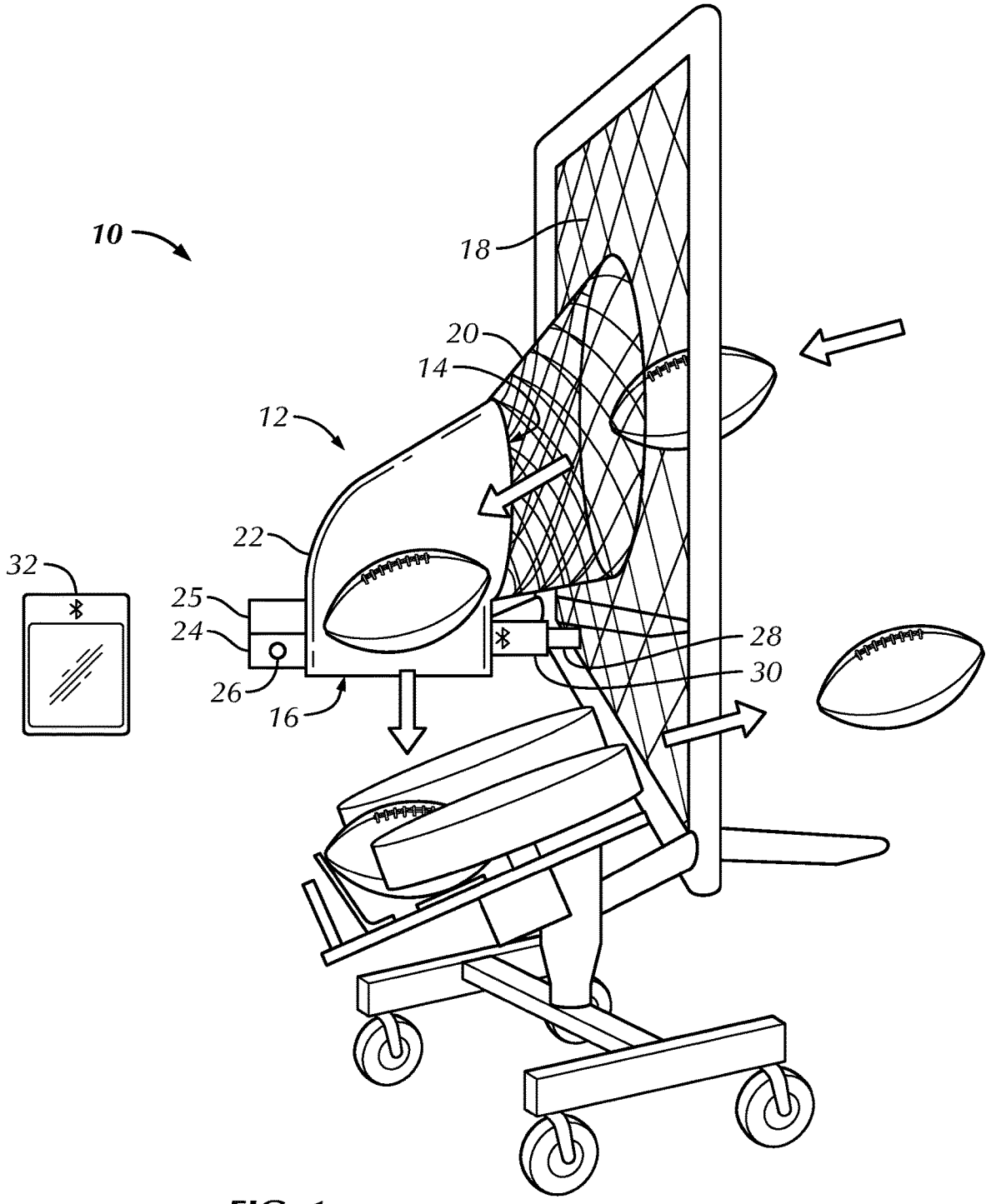
FIG. 1 is a front view of a football throwing apparatus in accordance with an embodiment of the present invention.

Referring now to the drawings, wherein like reference numerals designate identical or corresponding parts throughout the several views, preferred embodiments of the present invention are described.

Figure 2:
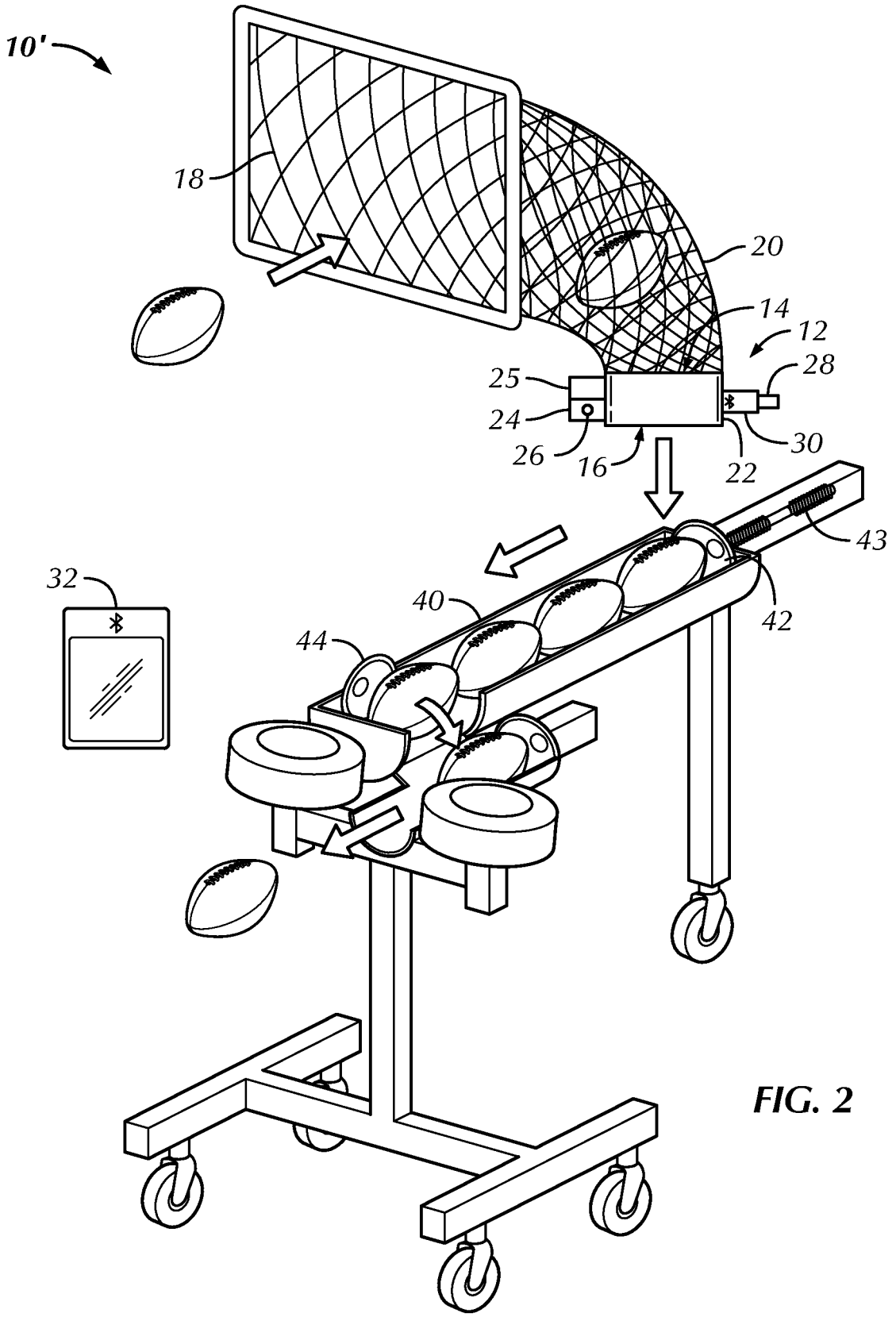
FIG. 2 is a front view of the football throwing apparatus illustrating a football being feed into the apparatus in an operational mode in accordance with an embodiment of the present invention.

Referring to FIGS. 1 and 2, a football throwing apparatus in accordance with embodiments of the present invention, is shown. According to this non-limiting embodiment, the football throwing apparatus 10 includes a housing 12, a flexible portion 18, a transport portion 40, an activation module 24, and a power module 25. The housing 12 includes a transport portion 40 having a receiving portion 41 for receiving a football and an integrated ejecting mechanism 42, 43 and 44 for adjustably ejecting into an ejecting portion 47 where a motorized throwing mechanism 45 (a standard motor is not shown) throws the football. It is understood that any motor now known or hereafter created may be utilized with the present invention. The flexible portion 18 includes a chute 20 configured to gravity funnel a football out of opening 16 into the receiving portion 41. The transport portion 40 is configured to transport the football from the receiving portion 41 to the ejecting portion 47 by means of ejecting mechanism 42, 43 and 44. The activation module 24 is configured to engage the ejecting mechanism 42, 43 and 44 to eject the football. The power module 25 is configured to electrically power the transport portion 22, the activation module 24 and optionally a standard motor (not shown) to throw the football.

According to one non-limiting embodiment, the activation module 24 includes a timer 26. A forward-facing camera 28 having a motion detection module 30 is attached to the housing 12. A rectangular user interface is attached to the rear or side of the apparatus 10. The apparatus 10 includes a wireless receiver 32.

A plurality of footballs may be loaded into a receiving portion of the football throwing apparatus. The throwing speed, angle and distance may be adjusted. According to one non-limiting embodiment the distance may be adjusted from 10' to 50'. According to one non-limiting embodiment the football throwing apparatus includes a timer configured to activate the engagement of the throwing mechanism to launch footballs at a configurable interval from 5 seconds to 1 minute. According to another non-limiting embodiment the football throwing apparatus includes a wireless receiver in communication with a remote wireless transmitter to activate the engagement of the throwing mechanism. The wireless receiver may be any known receiver including without limitation, Wi-Fi, Bluetooth, radio, LED, infrared, laser and the like. According to yet another non-limiting embodiment the football throwing apparatus includes a camera and software that monitors a configurable area for the presence of a person to activate the engagement of the throwing mechanism. Such monitoring may be without limitation based on motion detection. The software may be configured to project the anticipated trajectory of the person receiving the football to activate the engagement of the throwing mechanism and/or adjust the throwing speed, angle and distance. The camera may also be configured to digitally record the reception of the football. According to one embodiment, the football throwing apparatus includes a learning module that adjusts the throwing angle and distance based on previous throw attempts to adjust for wind speed and temperature, or the anticipated trajectory of the person. For instance, if the person is practicing a maneuver that requires a stop and go or a sharp turn, then the learning module may anticipate such movement. According to one non-limiting embodiment the learning module includes a plurality of learning modes. Each learning mode may then be manually selected or its historical information cleared. In this way, different learning mode may be designated for different parties or different maneuvers of a single party. For instance, one learning mode may be designated for a stop and go maneuver whereas another learning mode may be designated for a sharp turn. According to one embodiment, the football throwing apparatus includes an alert module that communicates a signal to the user before the activation module is activated. The signal may be by any known means including without limitation a visual signal such as a blinking light, an auditory signal such as one or more tones, and the like.

Figure 3:
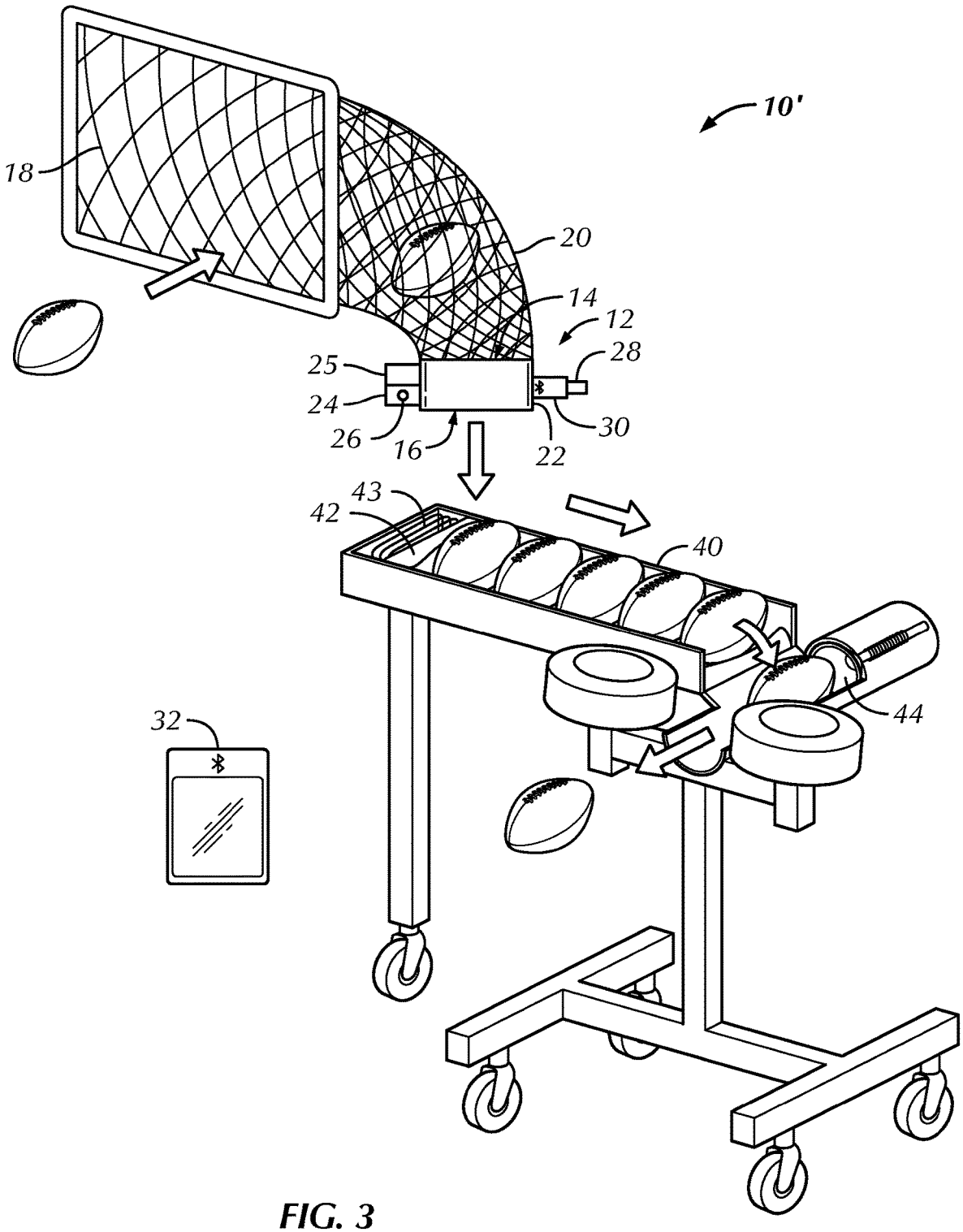
FIG. 3 is a front view of the football throwing apparatus illustrating a football being feed into the apparatus in an operational mode in accordance with an alternate embodiment of the present invention.

A football throwing apparatus in accordance with embodiments of the present invention is shown in FIG. 3. According to this alternative arrangement, the housing 12 includes a transport portion 40 arranged perpendicular to the ejecting portion 47 where a motorized throwing mechanism 45 (a standard motor is not shown) throws the football.

It will be apparent to those skilled in the art that various modifications and variations can be made in the individualized health evaluation system and method of the present invention without departing form the spirit or scope of the invention. Thus, it is intended that the present invention cover the modifications and variations of the invention provided they come within the scope of the appended claims and their equivalents.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. An automated football throwing apparatus comprising:

a housing having a receiving portion for receiving a football and an ejecting portion for adjustably ejecting the football;

a front-facing flexible portion having a front-facing circular opening extending into an integrated chute configured to gravity funnel the football into the receiving portion;

a transport portion configured to transport the football from the receiving portion to the ejecting portion;

an activation module configured to engage the ejecting portion to eject the football; and a power module configured to electrically power the transport portion and the activation module.

2. The apparatus of claim 1, further comprising a timer module in communication with the activation module, wherein the timer module is in communication with a user interface providing a configurable repeating timer to activate the activation module.

3. The apparatus of claim 1, wherein the ejecting portion is in communication with a user interface providing configuration of at least one selected from the group consisting of speed, angle and distance.

4. The apparatus of claim 1, further comprising a wireless receiver in communication with the activation module and a remote wireless transmitter, wherein signals from the remote wireless transmitter is configured to activate the activation module.

5. The apparatus of claim 4, wherein the signals are at least one selected from the group consisting of Wi-Fi, Bluetooth, radio, LED, infrared and laser.

6. The apparatus of claim 1, further comprising:

an infrared wireless receiver in communication with the activation module and a remote wireless transmitter, wherein signals from the remote wireless transmitter is configured to activate the activation module;

a motion detection module in communication with the infrared wireless receiver, wherein the motion detection module is configured to activate the activation module upon motion within a configurable area.

7. The apparatus of claim 1, further comprising a wireless receiver in communication with a remote wireless transmitter, wherein signals from the remote wireless transmitter is configured to configure the apparatus.

8. The apparatus of claim 1, further comprising a camera module comprising a video camera and a digital storage device, wherein the video camera is configured to communicate a video stream to the digital storage device, and wherein the digital storage device is configured to store the video stream.

9. The apparatus of claim 8, wherein the camera module further comprises a motion detection module in communication with video camera, wherein the motion detection module is configured to activate the activation module upon motion within a configurable area.

10. The apparatus of claim 9, wherein the camera module further comprises a learning module in communication with the motion detection module and the digital storage device, wherein the learning module is configured to project the anticipated trajectory of a user receiving the football based on historical data stored in the digital storage device and adjust the speed, angle, distance or timing of the activation module.

11. The apparatus of claim 10, wherein the learning module includes a plurality of learning modes, the historical data includes a plurality of separate historical data associated with each learning mode, and wherein each of the learning modes is configured to project the anticipated trajectory of a user receiving the football based on the respective separate historical data stored in the digital storage device and adjust the speed, angle, distance or timing of the activation module.

12. The apparatus of claim 1, further comprising an alert module in communication with the activation module and configured to provide a user receiving the football a signal a preconfigured time period before the activation module is activated.

13. The apparatus of claim 12, wherein the alert module is configured to provide at least one selected from the group consisting of an audio signal and a video signal.

14. An automated football throwing attachment attached to an automated football apparatus, wherein the automated football apparatus comprises a housing having a receiving portion for receiving a football and an ejecting portion for adjustably ejecting the football, the automated football throwing attachment comprising:

a front-facing flexible portion having a front-facing circular opening extending into an integrated chute configured to gravity funnel a football into the receiving portion;

an activation module configured to engage the ejecting portion to eject the football; and a power module configured to electrically power the activation module.

15. The attachment of claim 14, further comprising a timer module in communication with the activation module, wherein the timer module is in communication with a user interface providing a configurable repeating timer to activate the activation module.

16. The attachment of claim 14, wherein the ejecting portion is in communication with a user interface providing configuration of at least one selected from the group consisting of speed, angle and distance.

17. The attachment of claim 14, further comprising a wireless receiver in communication with the activation module and a remote wireless transmitter, wherein signals from the remote wireless transmitter is configured to activate the activation module, and wherein the signals are at least one selected from the group consisting of Wi-Fi, Bluetooth, radio, LED, infrared and laser.

18. The attachment of claim 14, further comprising:

an infrared wireless receiver in communication with the activation module and a remote wireless transmitter, wherein signals from the remote wireless transmitter is configured to activate the activation module;

a motion detection module in communication with the infrared wireless receiver, wherein the motion detection module is configured to activate the activation module upon motion within a configurable area.

19. The attachment of claim 14, further comprising a camera module comprising a video camera and a digital storage device, wherein the video camera is configured to communicate a video stream to the digital storage device, and wherein the digital storage device is configured to store the video stream.

20. The attachment of claim 19, wherein the camera module further comprises a motion detection module in communication with video camera, wherein the motion detection module is configured to activate the activation module upon motion within a configurable area.

21. The attachment of claim 20, wherein the camera module further comprises a learning module in communication with the motion detection module and the digital storage device, wherein the learning module is configured to project the anticipated trajectory of a user receiving the football based on historical data stored in the digital storage device and adjust the speed, angle, distance or timing of the activation module.

22. The attachment of claim 21, wherein the learning module includes a plurality of learning modes, the historical data includes a plurality of separate historical data associated with each learning mode, and wherein each of the learning modes is configured to project the anticipated trajectory of a user receiving the football based on the respective separate historical data stored in the digital storage device and adjust the speed, angle, distance or timing of the activation module.

23. The attachment of claim 14, further comprising an alert module in communication with the activation module and configured to provide a user receiving the football a signal a preconfigured time period before the activation module is activated.

24. The attachment of claim 14, wherein the alert module is configured to provide at least one selected from the group consisting of an audio signal and a video signal.

* * * * *